US005775422A

United States Patent [19]

Wong et al.

[11] Patent Number: 5,775,422

[45] Date of Patent: Jul. 7, 1998

[54] TREE TEST PLUG

[75] Inventors: Henry Wong; David E. Cain, both of Houston, Tex.; Jeffrey L. Mathews, Singapore, Singapore

[73] Assignee: FMC Corporation, Chicago, Ill.

[21] Appl. No.: 637,962

[22] Filed: Apr. 25, 1996

[51] Int. Cl.[6] ..... E21B 33/00

[52] U.S. Cl. ..... 166/135; 166/188

[58] Field of Search ..... 166/123, 135, 166/188, 85.1, 88.1

[56] References Cited

U.S. PATENT DOCUMENTS 3,250,331 5/1966 Boyle ..... 166/135 X 3,661,206 5/1972 Putch et al. ..... 166/313 X

*Primary Examiner*—William P. Neuder

*Attorney, Agent, or Firm*—Henry C. Query, Jr.

[57] ABSTRACT

A test plug for sealing a bore within a tubing hanger comprising an annular plug body having an axial bore extending therethrough, the axial bore forming a tapered annular seat and an enlarged receptacle within the plug body; a plurality of support dogs retractably mounted within corresponding slots formed in the plug body adjacent a lower portion of the receptacle; a mandrel slidably received within the receptacle, the mandrel having a downwardly and outwardly facing cam surface formed on a lower portion thereof; and a stinger having a tapered closure member adapted to be received in the annular seat, a spring for biasing the closure member against the seat and a seal ring for providing a fluid-tight seal between the closure member and the seat; wherein each support dog comprises an inner beveled edge formed on an upper portion thereof which preferably matches the cam surface of the mandrel, such that when the mandrel is set the cam surface will engage the beveled edge and urge the support dogs into an annular recess formed in the tubing hanger to thereby secure the test plug within the tubing hanger; and wherein the mandrel comprises an inwardly extending annular collar and the stinger comprises an outwardly extending ring forming a downwardly facing annular shoulder which overlaps the collar above the closure member, such that the closure member will not seal against the annular seat unless the mandrel is fully set, and the mandrel will release the closure member from the annular seat during retrieval of the test plug to thereby equalize the pressure above and below the test plug.

2 Claims, 5 Drawing Sheets

TREE TEST PLUG

BACKGROUND OF THE INVENTION

1. Field of the Invention

The present invention relates to a device used in pressure testing oil or gas well equipment. More particularly, the invention relates to a test plug for use in a tubing hanger or coupling of a wellhead apparatus for the purpose of containing pressure from above during testing of a Christmas tree.

2. Description of Related Art

A typical oil or gas well completion includes a series of casing strings initiating within a wellhead housing located at the mudline or subsea floor and continuing downward. The last casing string is called the production tubing, and it is suspended within the wellhead by a tubing hanger and extends down to the production zone of the well. After the well has been completed, a Christmas tree is connected over the wellhead to control the flow of oil or gas from the well. Prior to placing the Christmas tree into operation, however, it must be pressure tested. This is typically done by sealing off the well bore at the casing hanger and introducing pressurized fluid into the tree.

Test plugs are commonly used to seal off the production bore so that newly installed Christmas trees can be pressure tested. One example of such a test plug is disclosed in U.S. Pat. No. 4,121,660 issued to Koleilat, which is owned by the assignee hereof. As discussed in Koleilat, the casing hanger is formed with a recessed annular support groove and the test plug comprises a slideable mandrel positioned within the test plug body over a number of retractable dogs. Upon setting of the test plug, the mandrel engages the dogs and forces them outward into the support groove to thereby secure the test plug into the tubing hanger. The test plug also comprises a stinger which is normally biased into sealing engagement with an annular seat formed in an axial bore extending through the plug body to thereby seal the well bore.

However, some prior art test plugs comprise dogs which are difficult to expand and often require that the test plug be lifted slightly in order for the dogs to be properly set. In addition, some prior art test plugs may allow the stinger to fully engage the annular seat even if the dogs are not properly set, a condition that could cause the test plug to become wedged in the tubing hanger once pressure is introduced. Furthermore, some prior art test plugs provide no means of unseating the stinger from the annular seat during retrieval of the test plug to equalize the pressure above and below the tubing hanger.

Summary of the Invention

Therefore, it is an object of the present invention to provide a test plug which comprises dogs which may be expanded and properly set relatively easily. It is a further object of the invention to provide a test plug which prevents the stinger from sealing against the annular seat within the test plug body unless the dogs are properly set and locked into place. It is yet another object of the invention to provide a test plug which comprises means for unseating the stinger during retrieval of the test plug to thereby equalize the pressure above and below the test plug.

In accordance with the present invention, these and other objects and advantages are achieved by providing a test plug for sealing a bore within a tubing hanger comprising an annular plug body having an axial bore extending therethrough, the axial bore forming a tapered annular seat and an enlarged receptacle within the plug body; a plurality of support dogs retractably mounted within corresponding slots formed in the plug body adjacent a lower portion of the receptacle; a mandrel slidably received within the receptacle, the mandrel having a downwardly and outwardly facing cam surface formed on a lower portion thereof; and a stinger having a tapered closure member adapted to be received in the annular seat, a spring for biasing the closure member against the seat and a seal ring for providing a fluid-tight seal between the closure member and the seat; wherein each support dog comprises an inner beveled edge formed on an upper portion thereof which preferably matches the cam surface of the mandrel, such that when the mandrel is set the cam surface will engage the beveled edge and urge the support dogs into an annular recess formed in the tubing hanger to thereby secure the test plug within the tubing hanger; and wherein the mandrel comprises an inwardly extending annular collar and the stinger comprises an outwardly extending ring forming a downwardly facing annular shoulder which overlaps the collar above the closure member, such that the closure member will not seal against the annular seat unless the mandrel is fully set, and the mandrel will release the closure member from the annular seat during retrieval of the test plug to thereby equalize the pressure above and below the test plug.

These and other objects and advantages of the present invention will be made apparent from the following detailed description with reference to the accompanying drawings, wherein the invention and its associated components are depicted in partial vertical cross section, it being understood that the portions to the left of the longitudinal centerline are mirror images of the portions shown in each Figure.

Brief Description of the Drawings FIG. 1 is a partial vertical cross section of the tree test plug of the present invention shown attached to a running tool during the initial stages of installation into a tubing hanger;

.

DETAILED DESCRIPTION OF THE PREFERRED EMBODIMENTS

Figure 1:
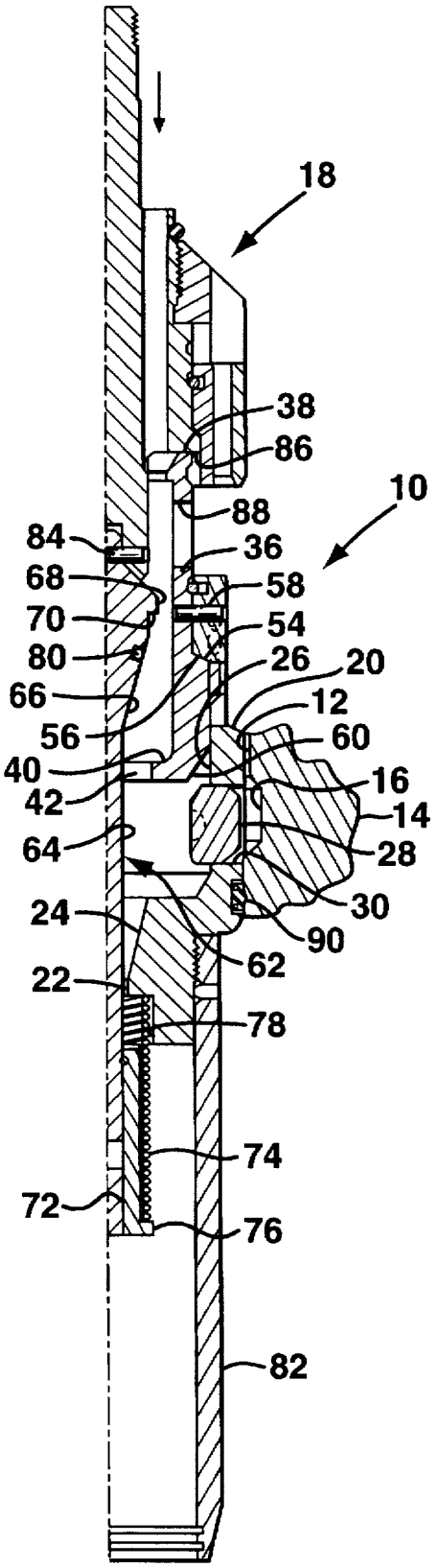

Referring to FIG. 1, the test plug of the present invention, indicated generally by reference number 10, is shown positioned, but not set, in a bore 12 of a tubing hanger 14 having a recessed annular support groove 16 formed therein. Tubing hanger 14 is located in a conventional wellhead (not shown), and test plug 10 is lowered into the wellhead on a running tool 18.

Figure 2:
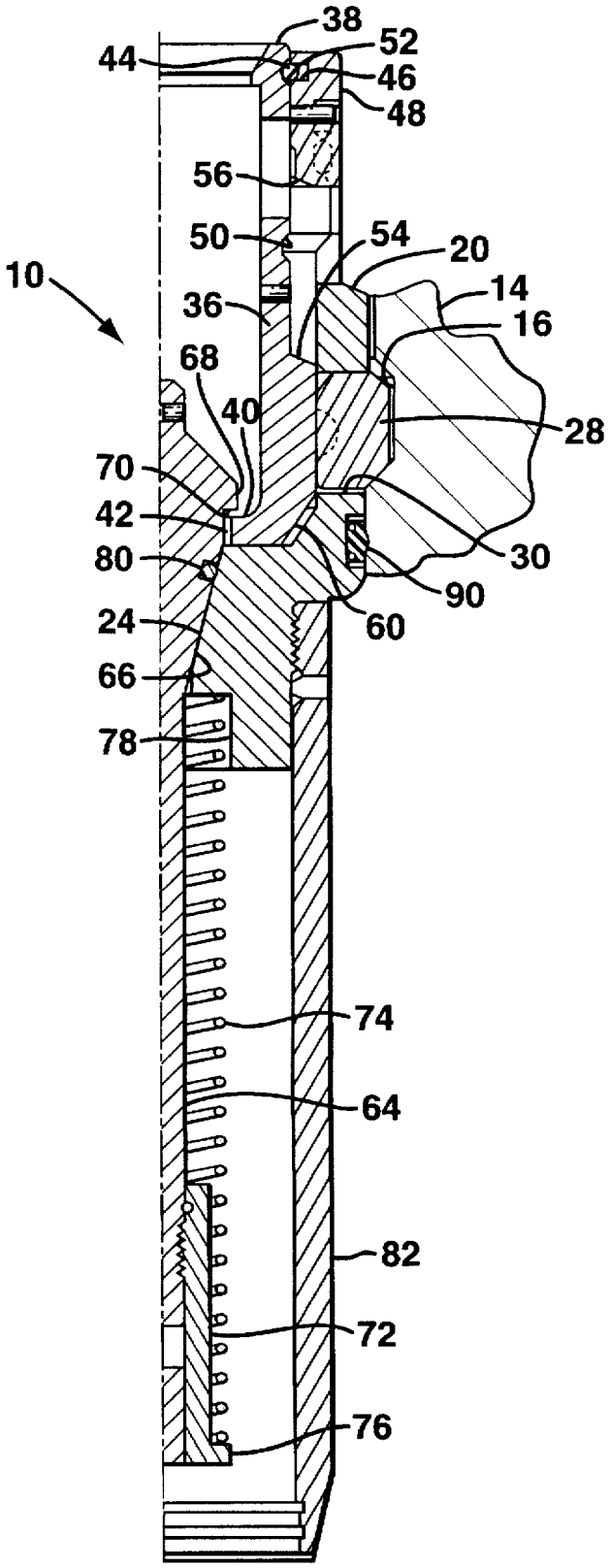
FIG. 2 is an enlarged, partial vertical cross section of the tree test plug in its fully set position and with the running tool removed.

Referring to FIGS. 1 and 2, test plug 10 comprises an annular plug body 20 having an axial bore extending therethrough defining a lower axial passage 22 communicating with the space below test plug 10, a tapered annular seat 24 extending upwardly from lower axial passage 22, and an enlarged annular receptacle 26 communicating with tapered seat 24. Test plug 10 also comprises a plurality of support dogs 28 positioned in slots 30 formed in plug body 20. Dogs 28 are radially movable in slots 30 and are retained therein by roll pins (not shown) or any other conventional means. Thus, as illustrated in FIG. 2, dogs 28 are extendible into support groove 16 of tubing hanger 14 to thereby secure test plug 10 in tubing hanger 14.

Figure 3:
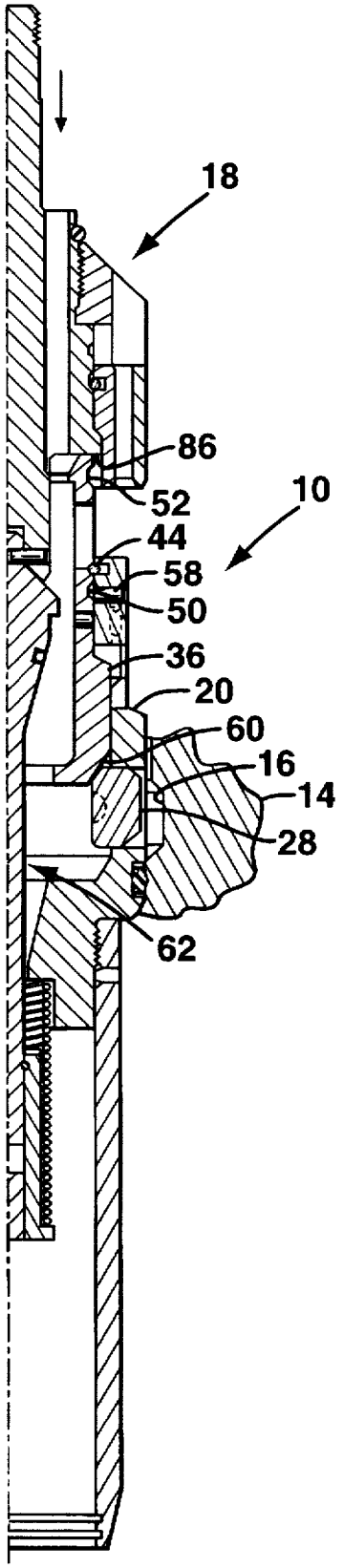
FIG. 3 is a partial vertical cross section of the tree test plug during the stage of installation wherein the mandrel first engages the dogs.
Figure 3A:
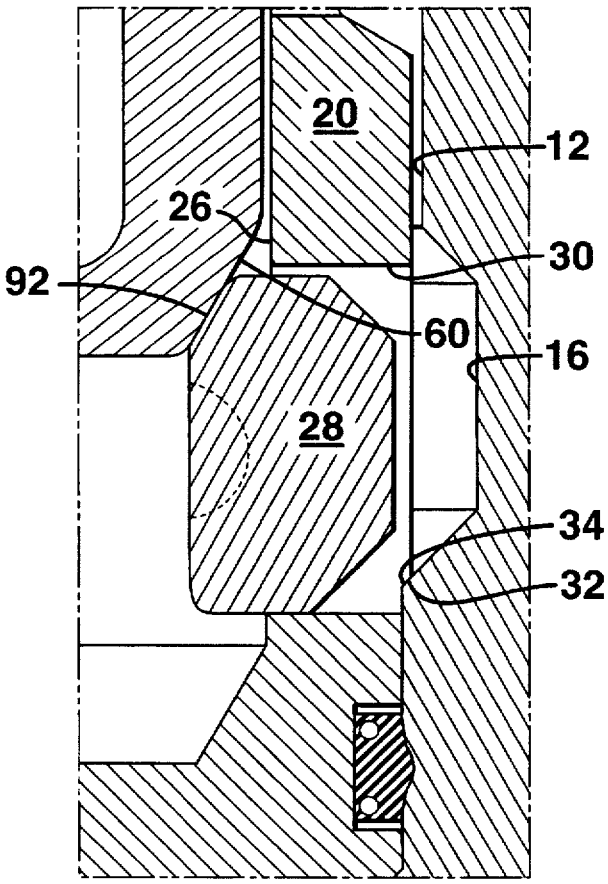
FIG. 3A is an enlarged, partial vertical cross section of a portion of the tree test plug depicted in FIG. 3.

As best seen in FIG. 3A, the diameter of plug body 20 above slots 30 is less than the diameter of plug body 20 below slots 30, thereby defining a small no-go shoulder 32 on plug body 20. In addition, the diameter of bore 12 of tubing hanger 14 above recessed groove 16 is greater than the diameter of bore 12 below recessed groove 16, thereby defining a small landing shoulder 34 within bore 12. Thus, as test plug 10 is lowered into bore 12, no-go shoulder 32 will land on landing shoulder 34 to position test plug 10 properly within tubing hanger 14 prior to being secured therein by dogs 28.

Referring again to FIGS. 1 and 2, test plug 10 further comprises a mandrel 36 slideably received within receptacle 26 of plug body 20. Mandrel 36 includes an upwardly facing surface 38 adjacent a top portion thereof and a inwardly extending annular collar 40 defining an opening 42 adjacent a lower portion thereof. A retainer ring 44 located in an inwardly facing annular groove 46 formed in a cap 48 connected to the upper portion of plug body 20 engages either a lower groove 50 or an upper groove 52 formed in the outer surface of mandrel 36 to retain mandrel 36 respectively in a raised position (depicted in FIG. 1) or a lowered position (depicted in FIG. 2). Mandrel 36 also comprises an upwardly facing beveled surface 54 which engages a corresponding downwardly facing beveled surface 56 formed on the lower portion of cap 48 when mandrel 36 is in the raised position. In preparation for installing test plug 10 into tubing hanger 14, mandrel 36 is secured in its raised position to cap 48 and, thus, plug body 20 by one or more shear pins 58. Mandrel 36 further comprises a downwardly and outwardly facing cam surface 60 formed on the lower portion thereof, the purpose of which will be described below.

Test plug 10 also comprises a stinger 62 having an elongated stem 64, a tapered closure member 66 integral with the top of stem 64, an outwardly extending ring 68 defining a downwardly facing annular shoulder 70 above closure member 66 and an elongated nut 72 connected to the lower portion of stem 64 by conventional means. A spring 74 is positioned around nut 72 between a collar 76 formed on a lower portion of nut 72 and a recess 78 formed in the bottom of plug body 20. Spring 74 normally urges stinger 62 downward to force closure member 66 against tapered seat 24 of plug body 20 to thereby seal the space below test plug 10 from above. A seal ring 80 may be provided around closure member 66 to form a fluid-tight seal between closure member 66 and seat 24. In addition, test plug 10 may comprise a spring housing 82 connected to a lower portion of plug body 20 to protect stinger 62 as test plug 10 is being lowered into the wellhead.

In preparation for running test plug 10 into the wellhead, test plug 10 is attached to running tool 18 by means of a shear pin 84 connecting the lower portion of running tool 18 to the upper portion of stinger 62. In this configuration, a downward facing section 86 of running tool 18 is proximate upwardly facing surface 38 of mandrel 36, and mandrel 36 is secured in its raised position by shear pin 58. One or more windows 88 formed in mandrel 36 allow shear pin 84 to be set during attachment of test plug 10 to running tool 18.

As test plug 10 is lowered into bore 12 of tubing hanger 14, no-go shoulder 32 of plug body 20 will land on landing shoulder 34 in bore 12. A seal 90 positioned in a corresponding groove formed in the outer surface of plug body 20 will then form a fluid-tight seal between test plug 10 and bore 12. Thus, when test plug 10 is landed on shoulder 34, the only means for communicating between the spaces above and below tubing hanger 14 is through lower axial passage 22 and tapered seat 24 formed within plug body 20.

Referring now to FIGS. 3 and 3A, after test plug 10 is landed on shoulder 34, running tool 18 will continue to move downward in order to set test plug 10 in tubing hanger 14. The continued downward movement of running tool 18 will cause downward facing section 86 of running tool 18 to exert a downward force on mandrel 36 that will shear shear pin 58 and dislodge retainer ring 44 from lower groove 50. Mandrel 36 will thus be freed to slide downward in receptacle 26 under constant force from running tool 18. After sliding a short distance, cam surface 60 of mandrel 36 will engage a corresponding inward facing beveled surface 92 formed on the upper portion of each dog 38. Preferably, cam surface 60 and beveled surface 92 comprise the same incline, which is approximately thirty degrees in a preferred embodiment of the invention. Such an incline reduces the force of friction between cam surface 60 and dogs 28 an thereby reduces the force required to set test plug 10.

Figure 4:
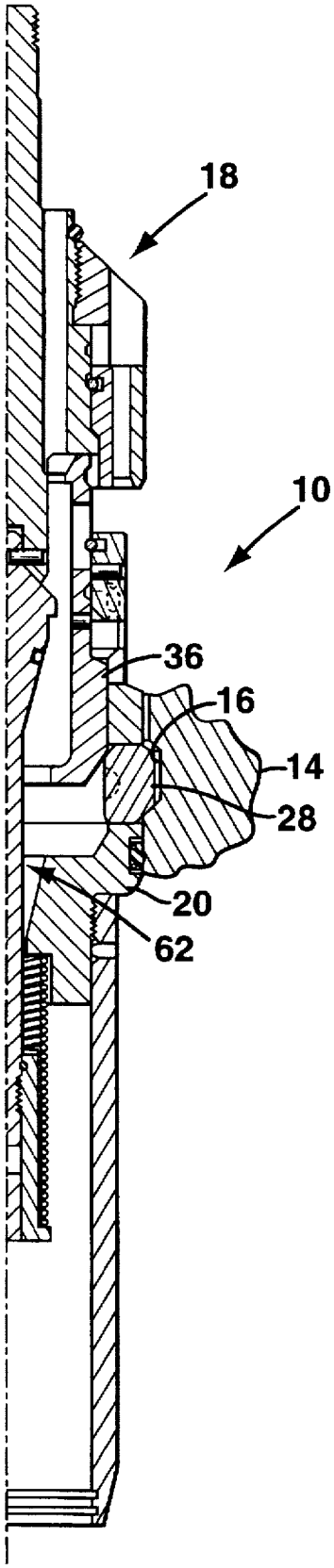
FIG. 4 is a partial vertical cross section of the tree test plug showing the dogs extending into a recessed groove formed in the tubing hanger.
Figure 4A:
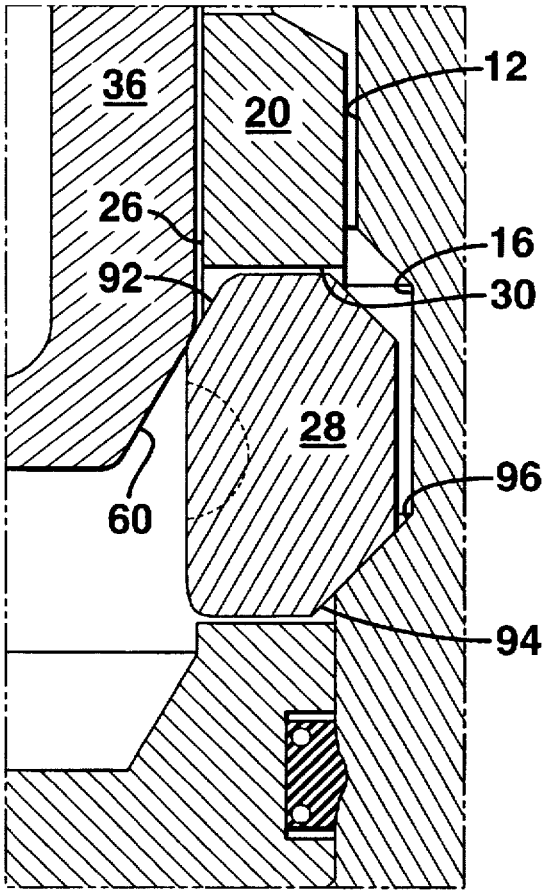
FIG. 4A is an enlarged, partial vertical cross section of a portion of the tree test plug depicted in FIG. 4.
Figure 5:
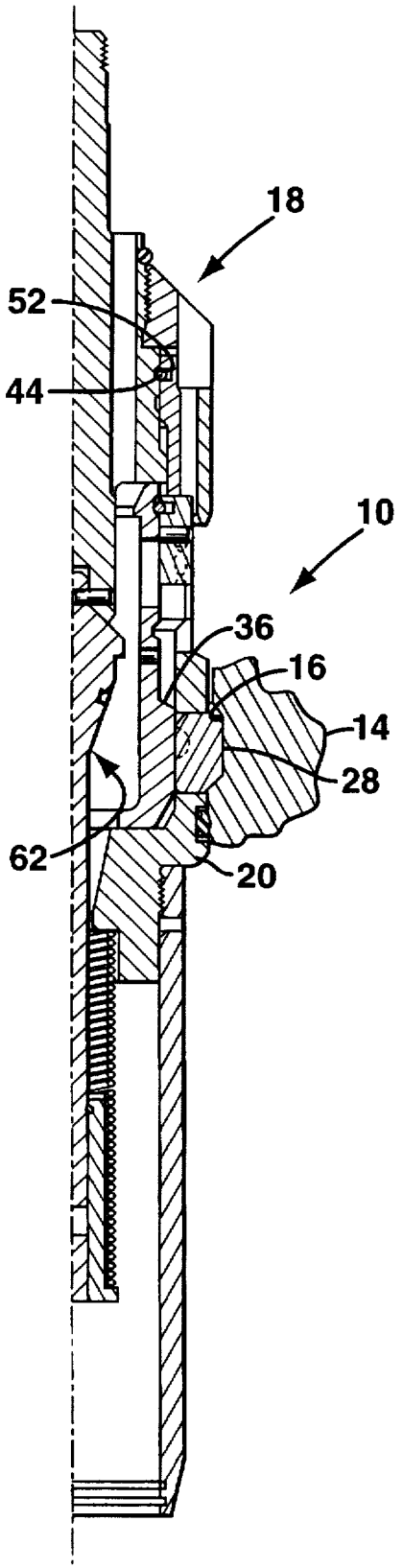
FIG. 5 is a partial vertical cross section of the tree test plug showing the dogs fully engaged and locked within the recessed groove formed in the tubing hanger.

Referring to FIGS. 4 and 4A, continued downward movement of mandrel 36 will force dogs 28 to extend into support groove 16. A lower inclined surface 94 of each dog 28 will engage a corresponding inclined surface 96 of support groove 16 and cause dogs 28 to raise slightly in slots 30 as they are extended into groove 16. Mandrel 36 will continue to move downward past dogs 28 until the bottom of mandrel 36 contacts the lower surface of receptacle 26, as depicted in FIG. 5. In this position, dogs 28 are locked in their fully extended position by mandrel 36. Mandrel 36 is retained in its lowered position by means of retainer ring 44 being engaged in upper groove 52.

Figure 6:
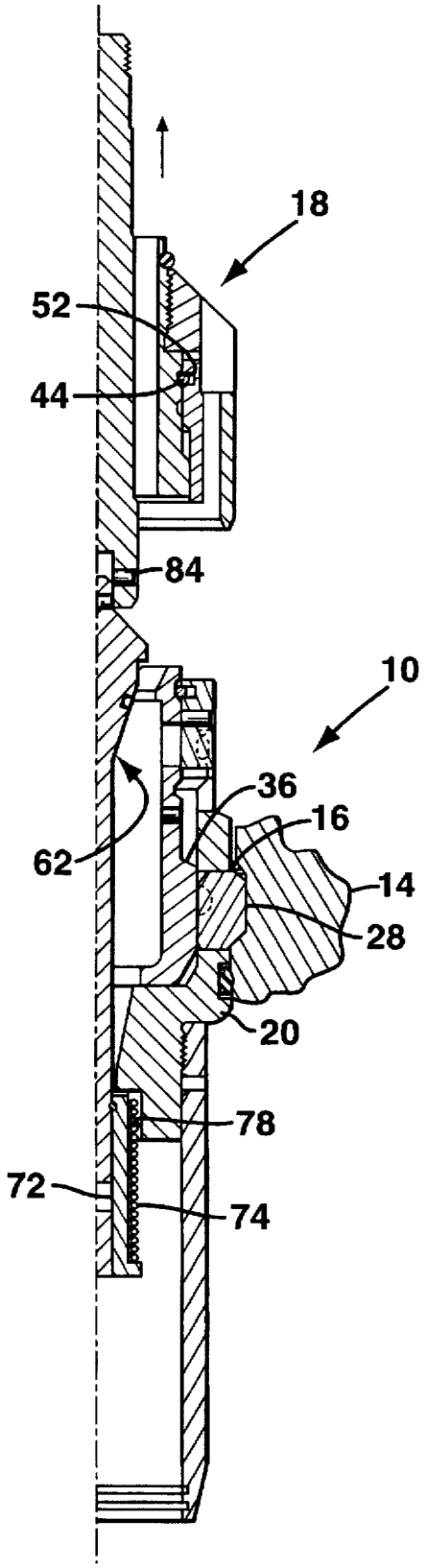
FIG. 6 is a vertical cross section of the tree test plug depicting the detachment of the running tool from the tree test plug.

At this point, running tool 18 is removed from test plug 10. Referring to FIG. 6, an upward force is exerted on running tool 18 which raises stinger 62 until nut 72 engages recess 78 in the bottom of plug body 20. Continued upward movement of running tool 18 causes shear pin 84 to shear and thereby disconnects running tool 18 from test plug 10. Stinger 62 then springs downward and closure member 66 sealingly engages seat 24 to set test plug 10, as depicted in FIG. 2.

Figure 7:
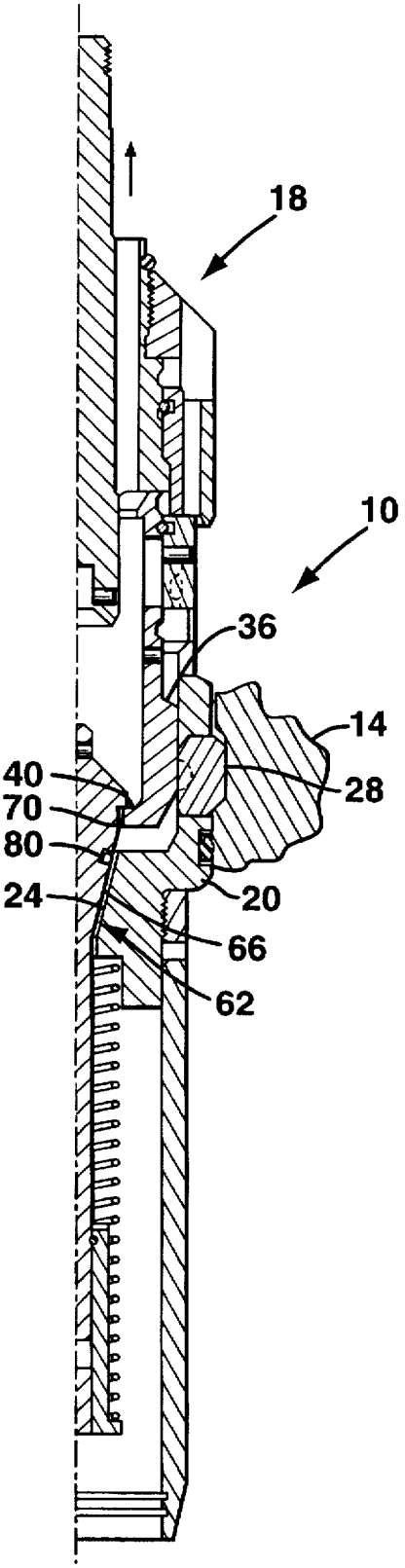
FIG. 7 is a vertical cross section showing the tree test plug improperly set within the tubing hanger.

According to the present invention, test plug 10 cannot be completely set unless mandrel 36 is in its lowered position, which ensures that dogs 28 are locked in their fully extended position. Referring to FIG. 7, if running tool 18 is disconnected from stinger 62 before mandrel 36 is in its lowered position, downward facing shoulder 70 of stinger 62 will engage collar 40 of mandrel 36 and thereby prevent closure member 66 and its associated seal 80 from engaging seat 24. In this position, test plug 10 will not hold pressure from above and an operator will thus have an indication that test plug 10 is not properly set.

Figure 8:
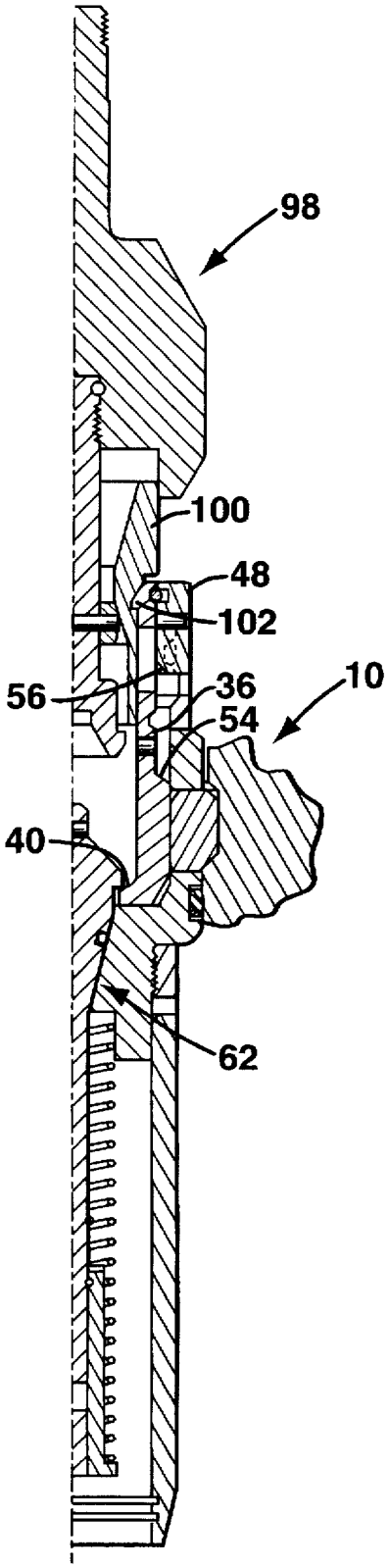
FIG. 8 is a vertical cross section showing the tree test plug engaged by a retrieval tool prior to removal from the tubing hanger.

Referring to FIG. 8, test plug 10 is removed from tubing hanger 14 by means of a retrieval tool 98, such as described in U.S. Pat. No. 5,474,124 issued to Samuels et al, which is owned by the assignee hereof. Retrieval tool 98 is lowered into the wellhead until fingers 100 engage an inwardly facing annular lip 102 formed on the upper portion of mandrel 36. When retrieval tool 98 is then lifted, fingers 100 will pull mandrel 36 upward, causing collar 40 to lift stinger 62 upward and release the seal between seat 24 on the one hand and closure member 66 and its associated seal 80 on the other hand. Once this seal is broken, the pressure above and below test plug 10 will be equalized, thereby reducing the force required to remove test plug 10. Upon further upward movement of mandrel 36, beveled surface 54 of mandrel 36 will engage beveled surface 56 of cap 48 and lift plug body 20 from bore 12 of tubing hanger 14.

It should be recognized that, while the present invention has been described in relation to the preferred embodiments thereof, those skilled in the art may develop a wide variation of structural details without departing from the principles of the invention. Therefore, the appended claims are to be construed to cover all equivalents falling within the true scope and spirit of the invention.

What is claimed is:

1. A test plug for sealing a bore within a tubing hanger comprising:

an annular plug body having an axial bore extending therethrough, the axial bore forming an annular seat and an enlarged receptacle within the plug body;

a plurality of support dogs retractable mounted within corresponding slots formed in the plug body;

a mandrel slidably received within the receptacle, the mandrel having a downwardly and outwardly facing cam surface formed on a lower portion thereof;

a stinger having a closure member adapted to be received in the annular seat, means for biasing the closure member against the seat and a seal ring for providing a fluid-tight seal between the closure member and the seat;

wherein each support dog comprises an inner beveled edge formed on an upper portion thereof which preferably matches the cam surface of the mandrel;

whereby when the mandrel is moved downward in the receptacle, the cam surface will engage the beveled edge and urge the support dogs into an annular recess formed in the tubing hanger to thereby secure the test plug within the tubing hanger; and wherein the mandrel comprises an inwardly extending annular collar and the stinger comprises an outwardly extending ring forming a downwardly facing annular shoulder which overlaps the collar above the closure member.

2. A test plug for sealing a bore within a tubing hanger comprising:

an annular plug body having an axial bore extending therethrough, the axial bore forming an annular seat and an enlarged receptacle within the plug body;

a plurality of support dogs retractably mounted within corresponding slots formed in the plug body;

a mandrel slidably received within the receptacle, the mandrel having a downwardly and outwardly facing cam surface formed on a lower portion thereof;

a stinger having a closure member adapted to be received in the annular seat, means for biasing the closure member against the seat and a seal ring for providing a fluid-tight seal between the closure member and the seat;

wherein the mandrel comprises an inwardly extending annular collar and the stinger comprises an outwardly extending ring forming a downwardly facing annular shoulder which overlaps the collar above the closure member.

* * * * *